US006614706B2

(12) United States Patent
Feurle

(10) Patent No.: US 6,614,706 B2
(45) Date of Patent: Sep. 2, 2003

(54) VOLTAGE REGULATING CIRCUIT, IN PARTICULAR FOR SEMICONDUCTOR MEMORIES

(75) Inventor: Robert Feurle, Neubiberg (DE)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/977,805

(22) Filed: Oct. 15, 2001

(65) Prior Publication Data

US 2002/0080675 A1 Jun. 27, 2002

(30) Foreign Application Priority Data

Oct. 13, 2000 (DE) ..... 100 50 761

(51) Int. Cl.[7] ..... G11C 7/00

(52) U.S. Cl. ..... 365/226; 365/189.09; 323/269; 327/538

(58) Field of Search ..... 365/226, 189.09; 323/274, 297, 280, 284, 269, 281; 327/538, 540, 541

(56) References Cited

U.S. PATENT DOCUMENTS 4,779,037 A * 10/1988 LoCascio ..... 323/281
5,412,309 A * 5/1995 Ueunten ..... 323/316
5,578,960 A * 11/1996 Matsumura et al. ..... 323/280
5,917,765 A * 6/1999 Morishita et al. ..... 365/201
5,956,278 A 9/1999 Itou ..... 365/201
6,049,200 A * 4/2000 Hayashimoto ..... 323/269
6,222,353 B1 * 4/2001 Pattamatta et al. ..... 323/269
6,340,918 B2 * 1/2002 Taylor ..... 323/314

OTHER PUBLICATIONS

Grebene, Allan: "Bipolar and MOS Analog Integrated Circuit Design", Wiley Interscience 1984, pp. 482–483.

* cited by examiner

*Primary Examiner*—Hoai Ho
*Assistant Examiner*—Gene N. Auduong
(74) *Attorney, Agent, or Firm*—Laurence A. Greenberg; Werner H. Stemer; Gregory L. Mayback

(57) ABSTRACT

The voltage regulating circuit, in particular for semiconductor memories, has a reference-voltage generator for generating a reference voltage, an in-phase element for providing a regulated voltage, and an error amplifier for forming a control loop. The in-phase element has a plurality of transistors which are permanently connected to one another on the control side and the load terminals of which are disconnectably connected, in dependence on the required drive strength, to a terminal that outputs the regulated voltage. The voltage regulating circuit is particularly suitable for supplying the voltage for embedded DRAM memories with an application-dependent storage capacity.

4 Claims, 1 Drawing Sheet

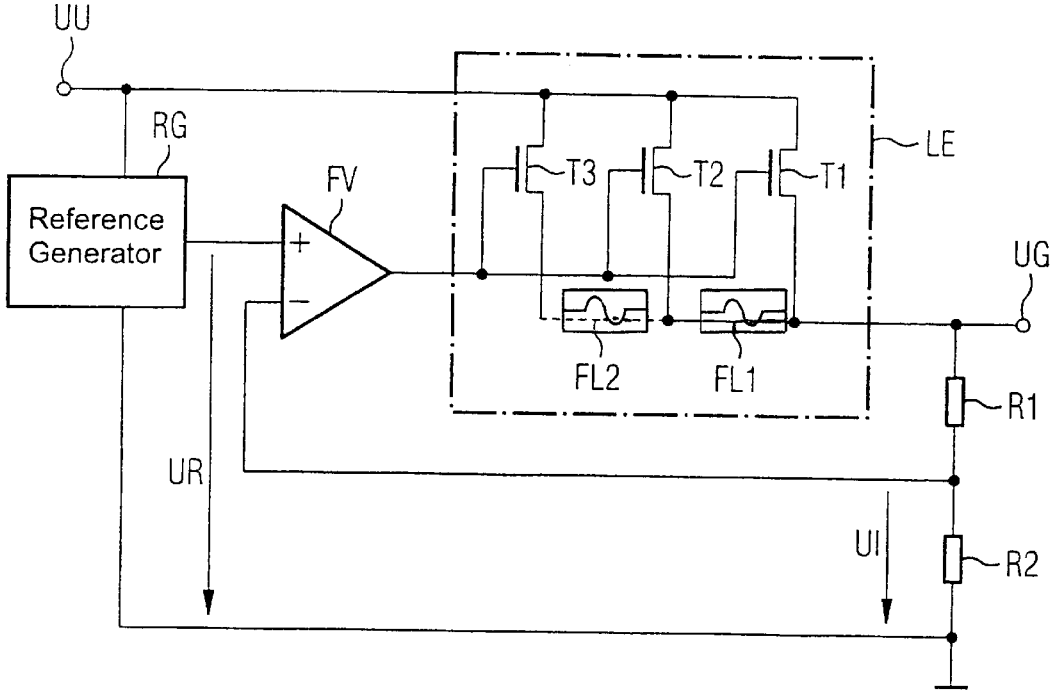
UU
RG
Reference Generator
FV
+
−
T3
T2
T1
LE
UG
FL2
FL1
R1
UR
UI
R2

VOLTAGE REGULATING CIRCUIT, IN PARTICULAR FOR SEMICONDUCTOR MEMORIES

BACKGROUND OF THE INVENTION

Field of the Invention

The present invention relates to a voltage regulating circuit, in particular for semiconductor memories, with a reference-voltage generator, which is connected to an input for supplying an unregulated voltage and provides a reference voltage, with an in-phase element, which is connected to the input for supplying the unregulated voltage and provides a regulated voltage at its output, and with an error amplifier, which on the input side is connected to the reference-voltage generator and is coupled to the output of the in-phase element and on the output side is connected to a control input of the in-phase element.

A generically determinative voltage regulator, in the form of an in-phase regulator or series regulator, is specified for example in the publication "Bipolar and MOS Analog Integrated Circuit Design", Allan Grebene, Wiley Interscience 1984, pages 482–83 (compare in particular FIG. 10.1). In that case, a reference-voltage generator generates a reference voltage which is independent of the unregulated supply voltage and temperature fluctuations. The error amplifier compares the reference voltage with a regulated output voltage and generates a corrective error signal, in order to influence the voltage drop along the in-phase element. As can be demonstrated, the regulated output voltage of the voltage regulating circuit is in first approximation independent of the unregulated input voltage and proportional to the reference voltage.

If the prior art voltage regulating circuit is used in what are known as embedded DRAMs (Dynamic Random Access Memories), in which the storage capacity can in each case depend on the application requirements and may vary within large ranges, the series regulator described displays disadvantages to the extent that, on the one hand, the driving capability of the voltage regulating circuit has to be electrically adapted to the respective load and, on the other hand, due to the adaptation of the driving capability the regulating characteristic of the voltage regulation likewise has to be adapted, in order to ensure a stable regulator response at all times.

In the way already known, the voltage regulators were designed for the maximum envisaged electrical load in each case. This involved adapting the regulator characteristic in each case by additional "dummy" capacitances in a laborious way.

U.S. Pat. No. 5,956,278 (German application DE 197 27 789 A1) discloses a voltage regulator in which, to provide test operation, one of two driver transistors connected in parallel to the output of the regulator is able to be switched off on the control side. However, this has the effect of changing the electrical load at the output of the voltage regulator.

SUMMARY OF THE INVENTION

It is accordingly an object of the invention to provide a voltage regulating circuit, which overcomes the above-mentioned disadvantages of the heretofore-known devices and methods of this general type and can be adapted in a simple way and with little effort for different applications, in particular to different capacitive loads.

With the foregoing and other objects in view there is provided, in accordance with the invention, a voltage regulating circuit, comprising:

an input for receiving an unregulated voltage;

a reference-voltage generator connected to the input and providing a reference voltage;

an in-phase element having a control input and an output carrying a regulated voltage; and an error amplifier having an input side connected to the reference-voltage generator and coupled to the output of the in-phase element and having an output side connected to the control input of the in-phase element;

the in-phase element including a first transistor and a second transistor each having a control input permanently connected to the control input of the in-phase element and a controlled path, and wherein the controlled path of at least one of the first and second transistors is disconnectibly connected to the output of the in-phase element.

In accordance with an added feature of the invention, the in-phase element comprises at least one fusible link coupling the output of the in-phase element to the controlled path of the second transistor.

In accordance with a concomitant feature of the invention, the first and second transistors are p-channel field-effect transistors.

In other words, the objects of the invention are achieved by a voltage regulating circuit which is developed to the extent that the series element, i.e., the in-phase element, comprises a first transistor and a second transistor, the control inputs of which are permanently connected to the input of the in-phase element and in which the controlled path of at least one transistor is disconnectibly coupled to the input of the in-phase element.

The control inputs of the transistors are permanently connected to the input of the in-phase element, which is connected to the output of the error amplifier. As a result, the control loop has a constant load, which is formed for example by capacitances between control inputs and controlled paths of the transistors, with the result that the regulating characteristic, in particular the stability conditions, is independent of loads which can be connected to the terminal for the unregulated voltage, in particular capacitive or mixed-capacitive loads.

The in-phase element may in this case preferably be designed in such a way that its driving capability is adapted to the maximum electrical load which can be connected, independently of the electrical load actually connected or intended to be connected.

The in-phase element has a plurality of transistors, which are connected in parallel on the control side and are disconnectably connected to one another on the load side. It is advisable in this case for at least one terminal of a controlled path of a transistor to be permanently connected to the output of the in-phase element. Terminals of controlled paths of further transistors are disconnectably connected by means of potential disconnecting points to the output of the in-phase element. Electrically conductive connections can in this case be disconnected at the disconnecting points preferably by energy pulses. Depending on which driving capability is required of the voltage regulating circuit at its output, a desired number of transistors can be connected in parallel by disconnecting the terminals of their controlled paths. For example, 30 transistors may be permanently connected to one another by their control inputs and consequently be connected in parallel on the control side, while only 10 controlled paths of 10 transistors are connected to one another and to the output of the in-phase element. The remaining 20 terminals of the controlled paths of the remaining transistors in this example have no electrical connections to the output of the in-phase element, or connections disconnected at the potential disconnecting points. Consequently, a simple adaptation of the driving capability of the voltage regulating circuit to a wide variety of electrical loads is possible with little effort, without at the same time influencing the regulating characteristic or the stability conditions of the control loop.

The controlled paths may be permanently connected to one another and to the terminal for supplying an unregulated voltage, by a further terminal in each case.

If the voltage regulating circuit is used for supplying voltage to embedded DRAMs of different sizes or storage capacities, this means that just one voltage regulating circuit can be used for supplying memory cells of, for example, two megabits to 48 megabits.

The voltage regulating circuit can be realized without complex modifications in particular whenever, to realize large channel widths, the in-phase element of the voltage regulating circuit has in any case a plurality of transistors connected in parallel and is subdivided into individual fingers, as they are known. For example, to realize large channel widths for field-effect transistors of up to 1000 micrometers, usually a plurality of individual transistors are connected in parallel.

In an advantageous embodiment of the present invention, the in-phase element comprises at least one fusible link, which couples the output of the in-phase element to the controlled path of the second transistor. Fusible links as a possible way of realizing the potential disconnecting points are also referred to as fuse links. Such fusible links may be arranged, during or after a production process, for example at an exposed point and be disconnected by using laser beams or, on account of their special design, be disconnected by applying an overvoltage or an overcurrent to adapt the number of parallel-connected transistors in the in-phase element to the desired drive strength.

Another possible way of adapting the driving capability of the voltage regulating circuit is for the metal traces which connect the output of the in-phase element to the terminals of the controlled paths of the transistors not desired in the particular case to be removed already from the mask layout during a production process. In this case, there is advantageously no need for any further simulations of the circuit obtained, since the regulating characteristic, that is the ratio of the gain of the error amplifier to the load, formed by the in-phase element, always remains the same. Consequently, there is no need for any investigations dependent on the adaptation of the drive strength of the voltage regulating circuit, for example with respect to turn-on characteristics, tendency to oscillate, stability or transient response of the voltage regulation.

In a further, advantageous embodiment of the invention, the transistors are p-channel field-effect transistors.

Other features which are considered as characteristic for the invention are set forth in the appended claims.

Although the invention is illustrated and described herein as embodied in a voltage regulating circuit, in particular for semiconductor memories, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The FIGURE is a block diagram illustrating an exemplary embodiment of the invention.

DESCRIPTION OF THE PREFERRED EMBODIMENTS

Referring now to the sole figures of the drawing in detail, there is shown a voltage regulating circuit with an input aqt which an unregulated voltage UU is received and an output for providing a regulated voltage UG. A reference voltage UR is provided by a reference generator RG, which on the input side is connected to the terminal for supplying the unregulated voltage UU. An error amplifier FV is connected to the output of the reference-voltage generator RG. An actual voltage UI, obtained by voltage division from the regulated voltage UG, can be fed at a further input of the amplifier FV. A resistive voltage divider is provided for the voltage division, formed by a first resistor R1 and a second resistor R2. The error amplifier FV compares the reference voltage UR with the actual voltage UI and provides at its output a correction voltage, which is proportional to a product from the differential voltage of the reference voltage and actual voltage and from a gain factor. Connected to the output of the error amplifier FV is a series element or in-phase element LE, designed as an output stage, which is connected for its voltage supply to the terminal for supplying the unregulated voltage UU. At the output of the in-phase element LE, the regulated voltage UG can be derived.

The in-phase element LE comprises three p-channel field-effect transistors T1, T2, T3, the gate terminals of which are permanently connected to one another and are connected to the output of the error amplifier FV. One terminal of the controlled paths of the transistors T1, T2, T3 is respectively connected to the terminal for supplying the unregulated voltage UU. Another terminal of the controlled paths or of the channels of the first and second transistors T1, T2 is respectively permanently connected to the terminal for providing the regulated voltage UG. The third transistor T3 in the exemplary embodiment is not connected, however, on the load side to the output of the in-phase element LE; rather, a potential disconnecting point, in the form of a fusible link FL2, between the second and third transistor is disconnected, so that there is no conductive connection. A further fusible link FL1 between the first and second transistors T1, T2 is not disconnected in the exemplary embodiment. The fusible links FL1, FL2 may be disconnected, for example, by means of laser or by an intentional electrical overload.

Since the gate terminals of the transistors T1, T2, T3 are permanently connected to the error amplifier FV, the regulating characteristic of the control loop is not influenced by a disconnection of the fusible links FL1, FL2. This is so because, for the control loop, the in-phase element LE represents the electrical load, which is in particular a capacitive load. However, the control inputs of the transistors T1, T2, T3 of the in-phase element LE are always permanently connected to the output of the error amplifier. Nevertheless, the fusible links FL1, FL2 can be used to set the current intensity, and consequently the driving capability, of the voltage regulating circuit in dependence on the electrical load which can be connected to the terminal for providing the regulated voltage UG. The driving capability which can be set with the fusible links FL1, FL2 can also be interpreted as setting the channel widths of a single transistor in the in-phase element LE.

Instead of the three transistors T1, T2, T3 which can be connected in parallel on the load side, it is also possible for just two transistors T1, T2 to be provided, or for any number of further transistors to be provided. Further fusible links may be provided to correspond to the number of further transistors. In this respect it is conceivable for a group of transistors to be connected or disconnected on the load side by a single fusible link. Apart from the illustrated use of p-channel field-effect transistors, n-channel transistors may also be used, or else, with slight modifications within the scope of the invention, bipolar transistors may be used. DRAM memory cells, preferably with a storage capacity of between 4 and 16 megabits, may preferably be connected to the terminal for providing the regulated voltage UG.

With the voltage regulating circuit described, a simple adaptation of the driving capability to the electrical load to be supplied or to the number of memory cells to be connected is ensured.

I claim:

1. A voltage regulating circuit, comprising:

an input for receiving an unregulated voltage;

a reference-voltage generator connected to said input and providing a reference voltage;

an in-phase element having a control input and an output carrying a regulated voltage; and an error amplifier having an input side connected to said reference-voltage generator and coupled to said output of said in-phase element and having an output side connected to said control input of said in-phase element;

said in-phase element including a first transistor and a second transistor each having a control input permanently connected to said control input of said in-phase element and a controlled path, and wherein said controlled path of at least one of said first and second transistors is disconnectibly connected to said output of said in-phase element.

2. The voltage regulating circuit according to claim 1 in combination with a semiconductor memory device.

3. The voltage regulating circuit according to claim 1, wherein said in-phase element comprises at least one fusible link coupling said output of said in-phase element to said controlled path of said second transistor.

4. The voltage regulating circuit according to claim 1, wherein said first and second transistors are p-channel field-effect transistors.

* * * * *